US005500159A

United States Patent [19]

Martinsson

[11] Patent Number: 5,500,159

[45] Date of Patent: Mar. 19, 1996

[54] DEVICE FOR CONTROLLING A CARBURETOR OF AN INTERNAL COMBUSTION ENGINE

[75] Inventor: Pär B. G. Martinsson, Huskvarna, Sweden

[73] Assignee: Aktiebolaget Electrolux, Stockholm, Sweden

[21] Appl. No.: 404,418

[22] Filed: Mar. 15, 1995

[30] Foreign Application Priority Data

Jun. 1, 1994 [SE] Sweden ..... 9401881-9

[51] Int. Cl.[6] ..... F02M 1/02

[52] U.S. Cl. ..... 261/52

[58] Field of Search ..... 261/52

[56] References Cited

U.S. PATENT DOCUMENTS

| | | | |
|---|---|---|---|
| 1,764,621 | 6/1930 | Good | 261/52 |
| 2,420,917 | 5/1947 | Sutton et al. | 261/52 |
| 2,572,169 | 10/1951 | Mallory | 261/52 |
| 2,867,424 | 1/1959 | Sutton | 261/52 |
| 2,873,731 | 2/1959 | Richardson | 261/52 |
| 3,179,098 | 4/1965 | Highley et al. | 261/52 |
| 3,279,771 | 10/1966 | Herman et al. | 261/52 |
| 4,672,929 | 6/1987 | Wissmann et al. | 261/52 |

*Primary Examiner*—Tim R. Miles

*Attorney, Agent, or Firm*—Pearne, Gordon, McCoy & Granger

[57] ABSTRACT

A device for controlling a carburetor of an internal combustion engine comprises a throttle control for controlling a throttle (12), and a choke control for controlling a choke valve (14). The throttle control comprises a latch means (15) which in the open position of the throttle prevents closing of the choke valve, and the choke valve comprises a corresponding latch means (16) which in the closed position of the choke valve limits the extent of opening of the throttle.

3 Claims, 1 Drawing Sheet

DEVICE FOR CONTROLLING A CARBURETOR OF AN INTERNAL COMBUSTION ENGINE

The present invention relates to a device for controlling a carburetor of an internal combustion engine, comprising a throttle control for controlling a throttle, and a choke control for controlling a choke valve.

The device according to the invention is particularly adapted to small engines of the kind used in power-driven hand-held tools, such as motor saws.

The object of the invention is to provide an improved control of a carburetor in order to avoid problems in connection with starting and operation of the engine. As is well known in this field, incorrect controlling of a conventionally equipped carburetor may result in charging of too much fuel to the engine. Primarily, this may cause problems in connection with starting of the engine. Secondly, unburnt fuel may enter the muffler via the engine. In case the muffler has a catalyst, such unburnt fuel may be ignited thereby and produce a flame that could damage the catalyst and could also cause a risk of fire and burn injury.

This object has been achieved by means of a device of the kind mentioned above which according to the invention is characterized in that the throttle control comprises a latch means which in the open position of the throttle prevents closing of the choke valve, and the choke control comprises a corresponding latch means which in the closed position of the choke valve limits the extent of opening of the throttle.

Figure 1:
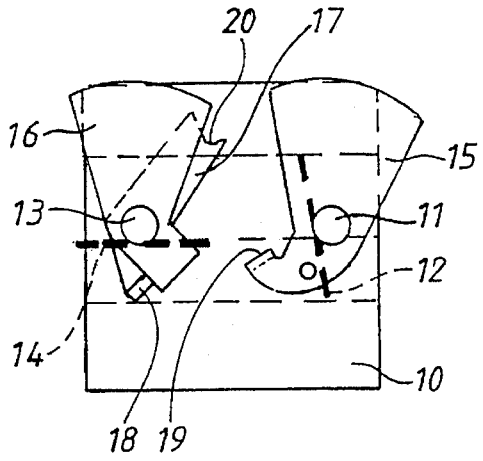
Figure 2:
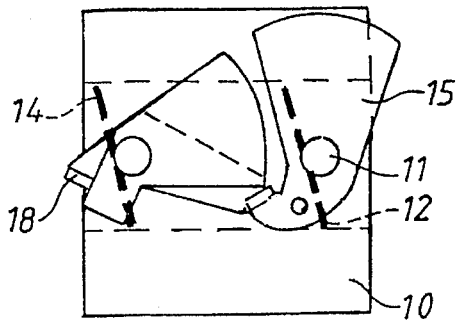
Figure 3:
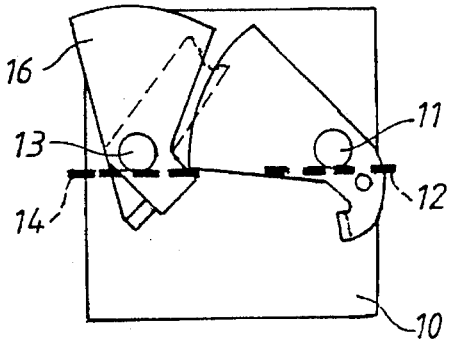

The invention will be described in further detail in the following with reference to the accompanying drawing, in which FIGS. 1–3 illustrate diagrammatical side elevations of a carburetor provided with the control device according to the invention, in three different positions.

In the drawing, a carburetor 10 is shown having a first shaft 11 for controlling a throttle 12 and a second shaft 13 for controlling a choke valve 14. The shafts 11, 13 are rotated in a conventional manner by means which are not shown. A latch means in the form of a lever 15 is attached to the shaft 11 in a non-rotatable manner, and the shaft 13 has a corresponding, non-ratatable latch means attached thereto in the form of a lever 16. Furthermore, the shaft 13 has a rotatably mounted lever 17 the lower end of which has a stop means 18 engaging the lower end of the lever 16. The two levers 15, 16 are made as circular segments at the top ends thereof. A stop means 19 is provided at the lower end of the lever 15, said stop means cooperating with a complementary recess 20 on the lever 17, as will be described below.

The shown device is resiliently actuated to assume the position of FIG. 1 in which the throttle is in an almost closed idling position and the choke valve is open. When starting a cold engine the choke valve is adjusted to the position in FIG. 2 in which the stop 19 of the lever 15 engages the recess 20, whereby the levers are latched in this position. The choke valve is closed and the throttle is opened a minor angle corresponding to fast idling speed of the engine. When the engine has started, the choke valve can be opened with the throttle remaining in the fast idling position. Alternatively, the throttle can be opened further, whereby the stop 19 is released from the engagement with the recess 20 and the choke valve returns to its open position due to actuation by the lever 17 which is resiliently actuated to assume the position shown in FIG. 1. In FIG. 3, the throttle as well as the choke valve are shown in their open positions corresponding to operation of the engine.

As is shown in FIG. 2, movement of the lever 15 is prevented by the lever 16. Therefore, the throttle opening cannot be increased appreciably as long as the choke valve is closed. Thus, in order to enable further opening of the throttle, the choke valve must be opened. Opening of the throttle is thereby prevented when the choke valve is closed, which could result in charging too much fuel to the engine before starting, and starting problems involved therewith. In the position shown in FIG. 3, movement of the lever 16 is prevented in a similar way by the lever 15. It is therefore not possible to close the choke valve when the throttle is open. Charging of too much fuel to the engine during operation is therefore prevented, which could cause an exhaust gas flame with an involved risk of of fire or burn.

As the levers 15, 16 latch each other, incorrect control of the carburetor is prevented, whereby starting of the engine is facilitated, and in addition, the risk of producing exhaust flames is reduced, which reduces the risk of burns and setting combustible material on fire.

I claim:

1. Device for controlling a carburetor of an internal combustion engine, comprising a throttle control for controlling a throttle (12), and a choke control for controlling a choke valve (14), characterized in that the throttle control comprises a latch means (15) which in the open position of the throttle prevents closing of the choke valve, and the choke control comprises a corresponding latch means (16) which in the closed position of the choke valve limits the extent of opening of the throttle.

2. Device according to claim 1, characterized in that the latch means (15, 16) comprise interacting levers non-rotatably attached to the shafts (11, 13) of the throttle (12) and the choke valve (14), respectively.

3. Device according to claim 2, characterized in that the levers comprise arc-shaped supporting surfaces.

* * * * *